US008855906B2

(12) United States Patent
Schwinn et al.

(10) Patent No.: US 8,855,906 B2
(45) Date of Patent: Oct. 7, 2014

(54) DATABASE AUGMENTED SURVEILLANCE

(75) Inventors: Daniel J. Schwinn, Melbourne Beach, FL (US); Edward A. Lester, Somerville, MA (US); Dean E. Ryan, Dublin, OH (US)

(73) Assignee: Avidyne Corporation, Lincoln, MA (US)

( * ) Notice: Subject to any disclaimer, the term of this patent is extended or adjusted under 35 U.S.C. 154(b) by 119 days.

(21) Appl. No.: 13/454,883

(22) Filed: Apr. 24, 2012

(65) Prior Publication Data

US 2012/0303252 A1 Nov. 29, 2012

Related U.S. Application Data

(60) Provisional application No. 61/490,898, filed on May 27, 2011.

(51) Int. Cl.
*G08G 5/00* (2006.01)
*G08G 5/04* (2006.01)

(52) U.S. Cl.
CPC ..... *G08G 5/045* (2013.01)
USPC ..... 701/120; 701/2; 701/9; 701/528

(58) Field of Classification Search
CPC ..... G01C 21/00; G01C 21/16; G01C 21/24; G01C 23/00; G01C 23/005
USPC ..... 701/2, 4, 7, 9, 14–16, 120, 301–302, 701/528
See application file for complete search history.

(56) References Cited

U.S. PATENT DOCUMENTS

| | | | | |
|---|---|---|---|---|
| 6,965,816 | B2 * | 11/2005 | Walker | 701/16 |
| 7,385,527 | B1 * | 6/2008 | Clavier et al. | 340/945 |
| 7,965,223 | B1 * | 6/2011 | Mccusker | 342/29 |
| 8,019,529 | B1 * | 9/2011 | Sharma et al. | 701/117 |
| 2002/0032528 | A1 * | 3/2002 | Lai | 701/301 |
| 2002/0069019 | A1 * | 6/2002 | Lin | 701/301 |
| 2002/0152029 | A1 * | 10/2002 | Sainthuile et al. | 701/301 |
| 2003/0004641 | A1 * | 1/2003 | Corwin et al. | 701/301 |
| 2003/0033084 | A1 * | 2/2003 | Corcoran, III | 701/301 |
| 2003/0093187 | A1 * | 5/2003 | Walker | 701/1 |
| 2004/0078136 | A1 * | 4/2004 | Cornell et al. | 701/120 |
| 2004/0225432 | A1 * | 11/2004 | Pilley et al. | 701/117 |
| 2005/0187677 | A1 * | 8/2005 | Walker | 701/16 |
| 2006/0069497 | A1 * | 3/2006 | Wilson | 701/120 |
| 2006/0167618 | A1 * | 7/2006 | Werback | 701/120 |
| 2006/0238406 | A1 * | 10/2006 | Nohara et al. | 342/90 |
| 2007/0126621 | A1 * | 6/2007 | Sandell et al. | 342/36 |
| 2007/0152804 | A1 * | 7/2007 | Breed et al. | 340/435 |
| 2007/0222665 | A1 * | 9/2007 | Koeneman | 342/29 |

(Continued)

*Primary Examiner* — Mary Cheung
*Assistant Examiner* — Atul Trivedi
(74) *Attorney, Agent, or Firm* — Hamilton, Brook, Smith & Reynolds, P.C.

(57) ABSTRACT

An aircraft traffic alert system that minimizes false alarms and unnecessary alerts by automatically adjusting the sensitivity of the system based on proximity to an airport. The system also can use information from a flight management system (FMS) or GPS navigation system (GNS) to only adjust the sensitivity near a destination airport and to suppress potential alerts for possible collisions with other aircraft that will be moot based on planned course changes of the subject aircraft. The system also can suppress alerts related to another aircraft when the other aircraft is landing on a parallel runway to the runway on which the subject aircraft is landing. The system may use multiple sensitivity levels based on different airspace classes, each class being associated with a different sensitivity level.

15 Claims, 7 Drawing Sheets

(56) References Cited

U.S. PATENT DOCUMENTS

| | | | | |
|---|---|---|---|---|
| 2008/0004792 | A1* | 1/2008 | Wise et al. | 701/120 |
| 2008/0103646 | A1* | 5/2008 | Lucas et al. | 701/14 |
| 2008/0195301 | A1* | 8/2008 | Fabre et al. | 701/120 |
| 2009/0201190 | A1* | 8/2009 | Huthoefer et al. | 342/27 |
| 2009/0265090 | A1* | 10/2009 | Poe et al. | 701/120 |
| 2010/0274418 | A1* | 10/2010 | Coulmeau et al. | 701/3 |
| 2011/0106442 | A1* | 5/2011 | Desai et al. | 701/208 |
| 2011/0118908 | A1* | 5/2011 | Boorman et al. | 701/14 |
| 2011/0184635 | A1* | 7/2011 | Khatwa et al. | 701/120 |
| 2011/0246003 | A1* | 10/2011 | Lafon et al. | 701/16 |
| 2011/0282582 | A1* | 11/2011 | Stayton et al. | 701/301 |
| 2012/0303252 | A1* | 11/2012 | Schwinn et al. | 701/120 |

* cited by examiner

DATABASE AUGMENTED SURVEILLANCE

RELATED APPLICATIONS

This application claims the benefit of U.S. Provisional Application No. 61/490,898, filed on May 27, 2011. The entire teachings of the above application(s) are incorporated herein by reference.

BACKGROUND OF THE INVENTION

Traffic alerting systems (e.g. Traffic Information Systems (TIS), Traffic Advisory Systems (TAS), Traffic Collision Avoidance Systems (TCAS), and Automatic Dependent Surveillance Broadcast (ADS-B) systems) are implemented in aircraft to monitor the location, speed, and heading of near-by aircraft and to alert a pilot to any aircraft that may present a threat of collision or other hazard. These systems all have a similar problem: the sensitivity needed enroute is different than that needed in the terminal environment. FIG. 1 shows an aircraft 102 and the size (i.e., sensitivity) of the area covered by traffic alerting systems. The terminal sensitivity area 104 is smaller than the enroute sensitivity area 106. Enroute, traffic alerting systems need to detect and alert conflicts at longer ranges due to the faster closing speeds encountered. There is also a lower density of traffic intruders in the enroute environment. This differs greatly from the terminal or airport environment where there is a higher density of traffic, which is slower moving. If the sensitivity that is optimal for the enroute environment is used in the terminal environment, there will be an increased number of false alarms, where a traffic intruder is alerted, but is not a threat. Additionally, if the sensitivity that is optimal for the terminal environment is used in the enroute environment, traffic alerts for intruders may be issued too late to prevent a collision or may require extreme maneuvering.

In previous systems, four methods have been used to adjust traffic alerting system's sensitivity. The first is manual control, where the pilot manually sets the sensitivity level. The second is based on pressure altitude. On departure, the pressure altitude increase is used to change from a terminal sensitivity to an enroute sensitivity. On approach, the pilot must manually set the destination airport elevation and as the plane descends towards the airport elevation, the sensitivity changes from enroute to terminal modes. This second method does not work well if an aircraft descends enroute but not near the destination airport. The third method involves the selection of a landing-related aircraft system, such as flaps or landing gear. When the landing system is deployed, indicating the pilot's intention to land, the traffic system changes sensitivity. This method does not work on aircraft with fixed landing gear or where the position of the landing gear or the flaps cannot be determined by the traffic system. The fourth method uses radio altitude to filter traffic on the ground, but only once a plane has descended below a certain altitude (often 2500 feet).

SUMMARY OF THE INVENTION

There is a market demand for an in-aircraft traffic alerting system that automatically adjusts its sensitivity based on the flying conditions and also that suppresses unnecessary alerts. Embodiments of the invention system determine a subject aircraft's present position, for example, using a GPS receiver, and comparing the determined position with a database of airport locations and respective predetermined airport airspace boundaries, and other airspaces, airways, etc. The traffic alert system automatically switches from a high sensitivity mode to a low (or lower) sensitivity mode when the determined position is within the predetermined airspace boundary of an airport of the database, or other airspaces, airways, etc. In other embodiments, the system only switches to the low (or lower) sensitivity mode if the aircraft is within the predetermined boundary of a destination airport. The system typically determines the destination airport from a flight plan an in-flight management system (FMS) or GPS navigation system (GNS). In other embodiments, alerts are suppressed. In other embodiments, the traffic alert system adjusts its sensitivity level to a level that corresponds with the class of airspace in which the aircraft is flying.

In other embodiments, the system suppresses alerts related to a possible collision with another aircraft if the subject aircraft's planned flight path will move it away from the collision with the second aircraft. In other embodiments, the system suppresses alerts related to another proximate aircraft if the other aircraft is on a final approach path to a runway that is parallel to a runway that the subject aircraft is on final approach to.

In other embodiments, the system receives information about the aircraft type of nearby aircraft and provides alert information based on flight characteristics of the type. For example, the system may provide a high risk warning over a large area for a Boeing 747-400 to account for collision risk and for risk associated with that aircraft type's large wake vortex. The system may also adjust the area around a nearby aircraft in which a warning is provided based on the maneuvering capabilities of the nearby aircraft type. The system also may look up in the database or have available (accessible) the maneuverability and flight characteristics of the aircraft in which it is installed, and use the information to alter alerting thresholds.

The system also may have intermediate sensitivity modes between the high sensitivity mode and the low sensitivity mode. The intermediate sensitivity mode may be one or more discrete sensitivity modes or may be a continuous sensitivity mode between the high sensitivity mode and the low sensitivity mode. The term continuous, as used herein, may mean infinite sensitivities between the high sensitivity mode and the low sensitivity mode, or may mean that increments between sensitivity levels are equal to or less than the capabilities of the system and/or the pilot to discern a change.

BRIEF DESCRIPTION OF THE DRAWINGS

The foregoing will be apparent from the following more particular description of example embodiments of the invention, as illustrated in the accompanying drawings in which like reference characters refer to the same parts throughout the different views. The drawings are not necessarily to scale, emphasis instead being placed upon illustrating embodiments of the present invention.

DETAILED DESCRIPTION OF THE INVENTION

A description of example embodiments of the invention follows.

A first embodiment combines a database with a surveillance system to provide improved services to the aircraft operator. The embodiment described here uses an airspace database and aircraft position and altitude to automatically set the sensitivity of the traffic system. The system utilizes an airspace database that contains latitudes, longitudes, and elevation of various airspaces and airways, e.g., an airspace above an airport. This database may be updated periodically. The system also uses a position and altitude source onboard the aircraft such as GPS to determine the aircraft's current position (latitude and longitude) and altitude. The system compares the current aircraft position and altitude with nearby airspace positions and altitudes as stored in the airspace database. As the aircraft travels within predetermined distances and altitudes from airspaces the traffic system automatically changes sensitivity levels. This happens automatically with no input (manual intervention) from the pilot.

The system also may have intermediate sensitivity modes between the high sensitivity mode and the low sensitivity mode. The intermediate sensitivity mode may be one or more discrete sensitivity modes or may be a continuous sensitivity mode between the high sensitivity mode and the low sensitivity mode. The term continuous, as used herein, may mean infinite sensitivities between the high sensitivity mode and the low sensitivity mode, or may mean that increments between sensitivity levels are equal to or less than the capabilities of the system and/or the pilot to discern a change.

Figure 1:
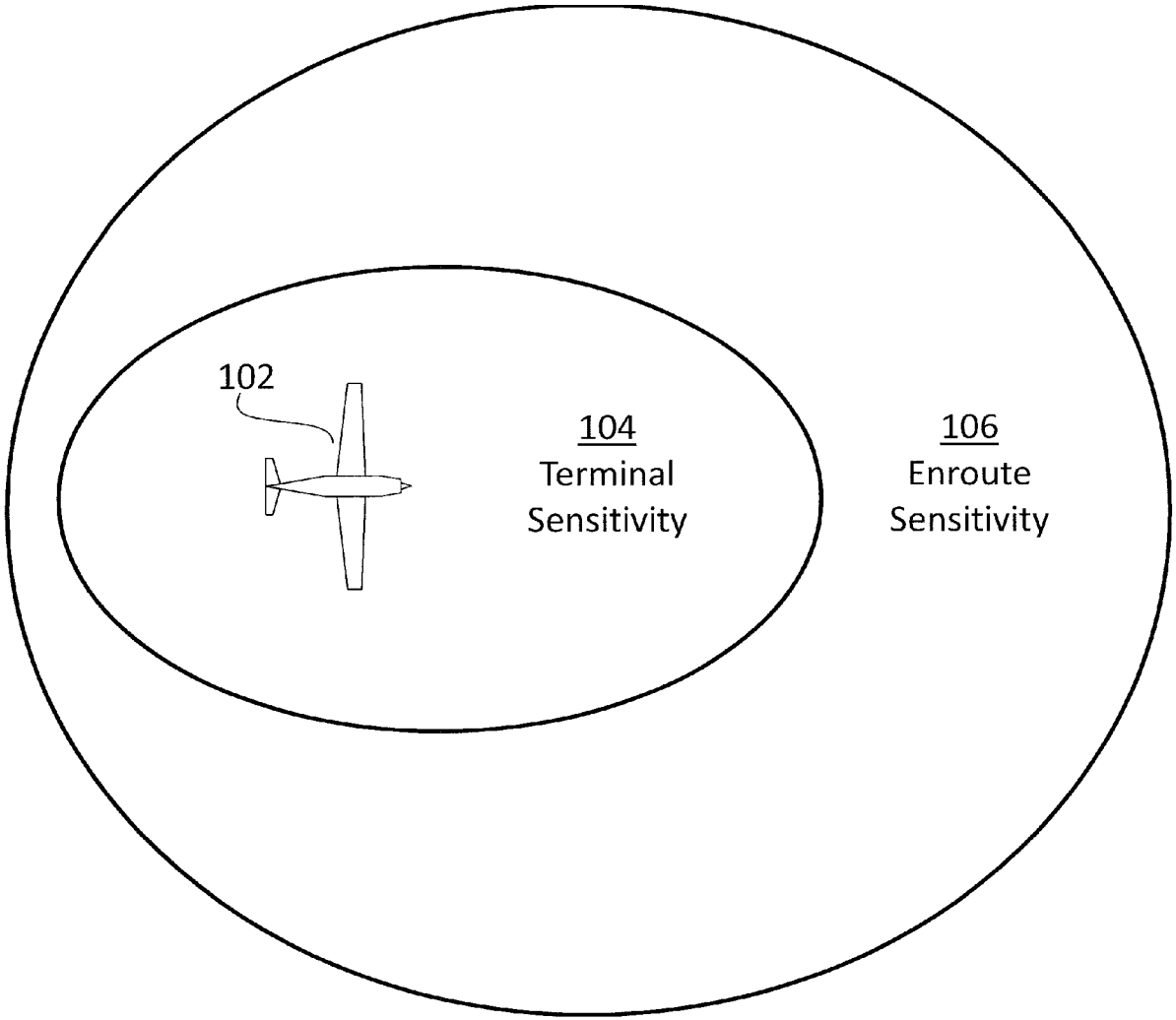
FIG. 1 PRIOR ART
FIG. 1 illustrates a prior art traffic alert system having two sensitivity levels.
Figure 2:
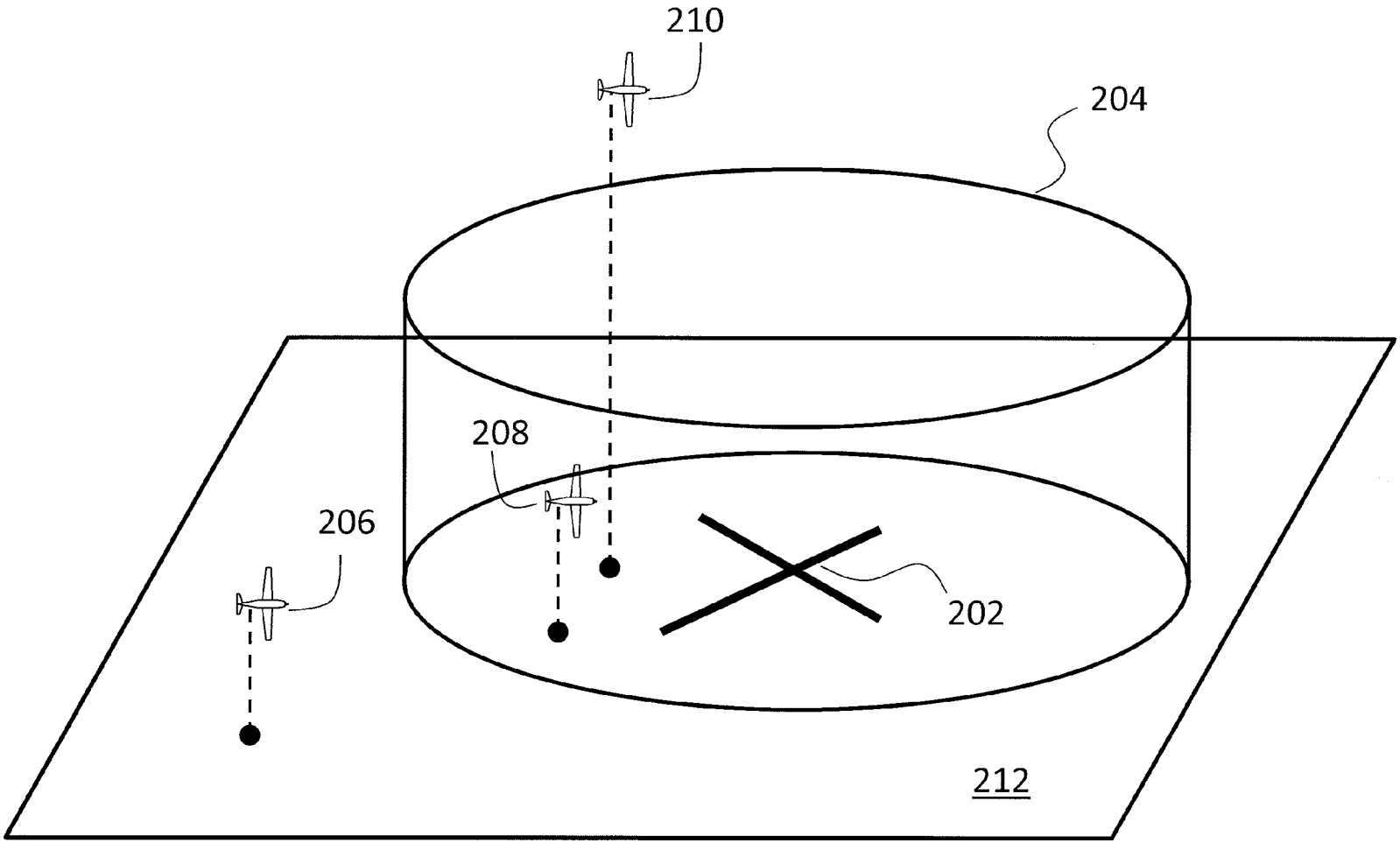
FIG. 2 illustrates an embodiment of a traffic alert system in which the sensitivity level is automatically changed when the aircraft enters a predetermined boundary of an airport.

FIG. 2 illustrates this first embodiment. An airport 202 is located on the ground 212. The airport 202 is surrounded by a predetermined airport airspace boundary 204 that extends away (e.g., radially) from the airport along the ground and also extends vertically upwards to some predetermined altitude above the airport 202. A first aircraft 206 is located at an altitude that is below the altitude of the predetermined airport airspace boundary 204, but it is located outside of boundaries on the ground of the predetermined airport airspace boundary 204. The first aircraft 206 has a system according to the first embodiment on board with a database that includes a record of the airport 202, its location, and the predetermined airport airspace boundary 204. The first aircraft 206 detects its position, e.g., using GPS, and determines that it is outside of the predetermined airport airspace boundary 204. Therefore, the system sets its traffic alerting system to an enroute sensitivity mode.

The second aircraft 208 is located at an altitude below the altitude of the predetermined airport airspace boundary 204, and also is located within the boundaries on the ground of the predetermined airport airspace boundary 204. The second aircraft 208 also has a system according to the first embodiment on board. The second aircraft 208 detects its position and determines that it is inside of the predetermined airport airspace boundary 204. Therefore, the system sets its traffic alerting system to a terminal sensitivity mode.

The third aircraft 210 is located within the boundaries on the ground of the predetermined airport airspace boundary 204, but is located at an altitude above the predetermined airport airspace boundary 204. The third aircraft 210 has a system according to the first embodiment on board. The third aircraft 210 detects its position and determines that it is outside of the predetermined airport airspace boundary 204. Therefore, the system sets its traffic alerting system to an enroute sensitivity mode.

Figure 3:
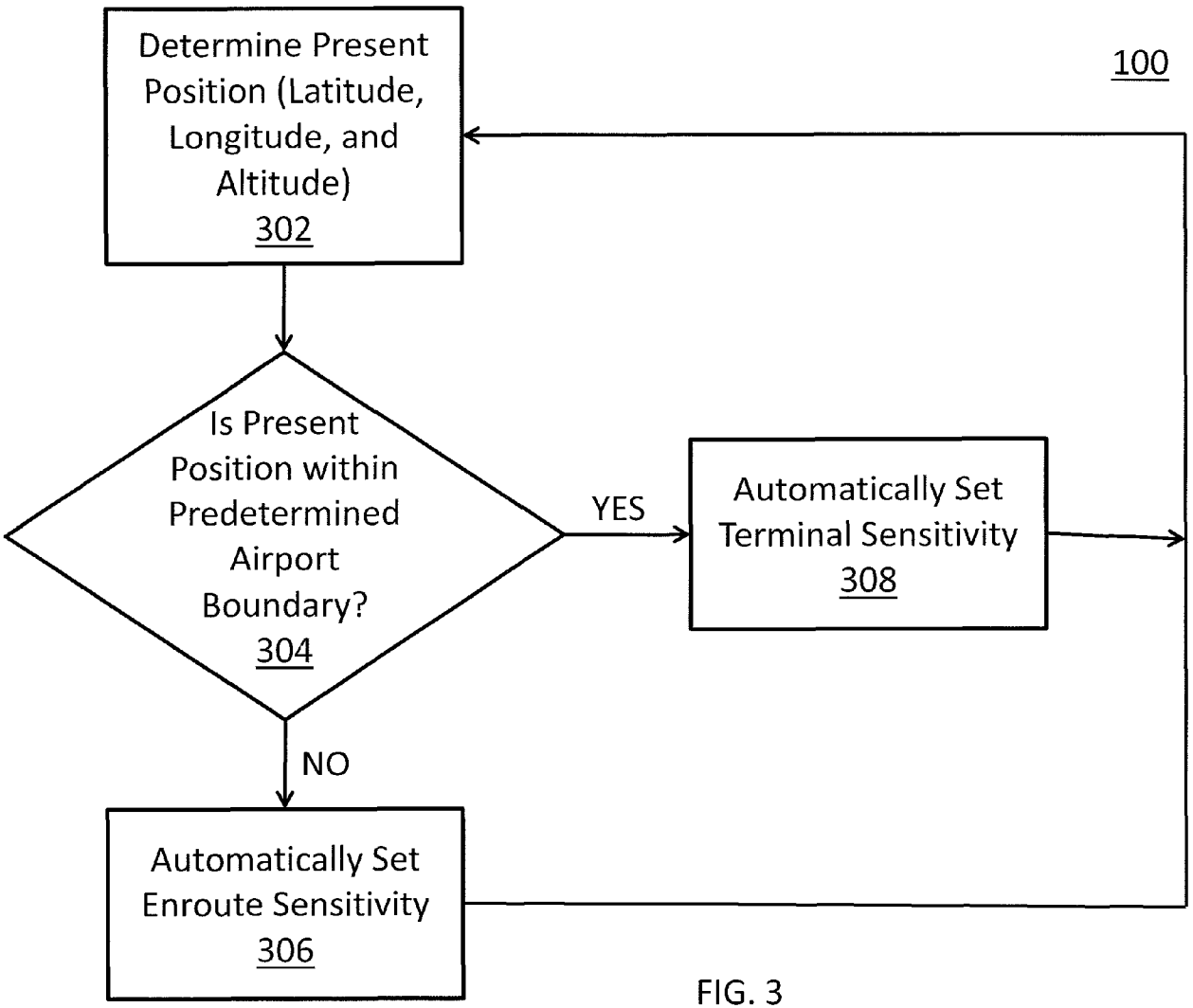
FIG. 3 is a flow chart showing the process for automatically changing the sensitivity of the traffic alert system based on proximity to a predetermined airport airspace boundary.

FIG. 3 is a flow chart for a system 100 according to the first embodiment described above. In a first step 302, the system on board an aircraft determines its present three-dimensional position (longitude, latitude, and altitude). In step 304, the system then compares the present three-dimensional position to a database of airspace locations (and predetermined airport boundaries) to determine whether the aircraft is within a predetermined airport airspace boundary. If the aircraft is not within a predetermined airport airspace boundary, then the aircraft's traffic alerting system is set to enroute sensitivity mode 306. If the aircraft is within a predetermined airport airspace boundary, then the aircraft's traffic alerting system is set to terminal sensitivity mode 308. As shown in FIG. 3, the steps shown repeat after a determination has been made and the sensitivity of the traffic alert system has been set. The system may repeat at any frequency, but it is preferable for the steps to repeat frequently to minimize the amount of time where the traffic alert system may be operating in the wrong sensitivity mode. As a non-limiting example, the sampling rate may be 1 to 2 Hertz.

Figure 7:
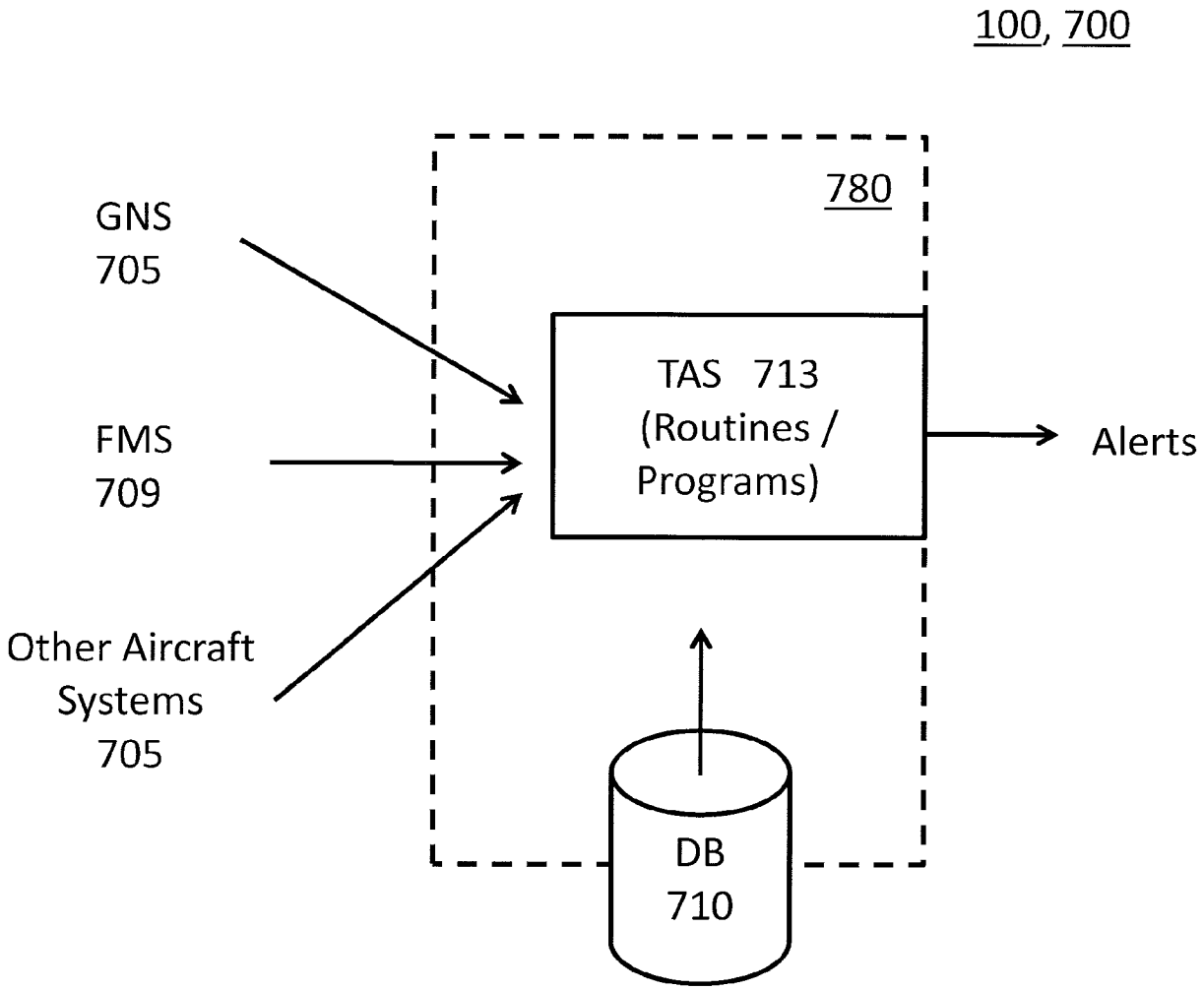
FIG. 7 is a block diagram of traffic alert system embodying the present invention.

FIG. 7 illustrates traffic alerting systems 100, 700 embodying the present invention. Common computer processors 780, working memory (RAM, ROM, etc.), and I/O and network interfaces are employed with traffic alert assembly (routines, programs, algorithms, etc.) or device 713. In the embodiment described above in FIGS. 2 and 3, the database 710 containing the locations of airports and respective associated predetermined airport airspace boundary is contained in an on board database. In other embodiments, the database 710 may be located on a real-time accessible remote network database. In other embodiments, the traffic alert system 700 may include additional sensitivity levels between enroute and terminal sensitivity, including continuously variable sensitivity levels based on proximity to a subject airport. For example, the system 700 (its program assembly 713) could compare its determined position to flight space classifications, e.g., FAA Class A, Class B, etc. airspace, and set the sensitivity level based on the characteristics of the particular airspace it is in. In other embodiments, the system 700 (program assembly 713) also may use an aircraft's Flight Management System (FMS) 709 or GPS Navigation System (GNS) 705 to determine the aircraft's destination airport and only change the traffic alert device 713 from enroute sensitivity to terminal sensitivity when the system determines that the aircraft is within the predetermined airport airspace boundary of the destination airport.

Figure 6:
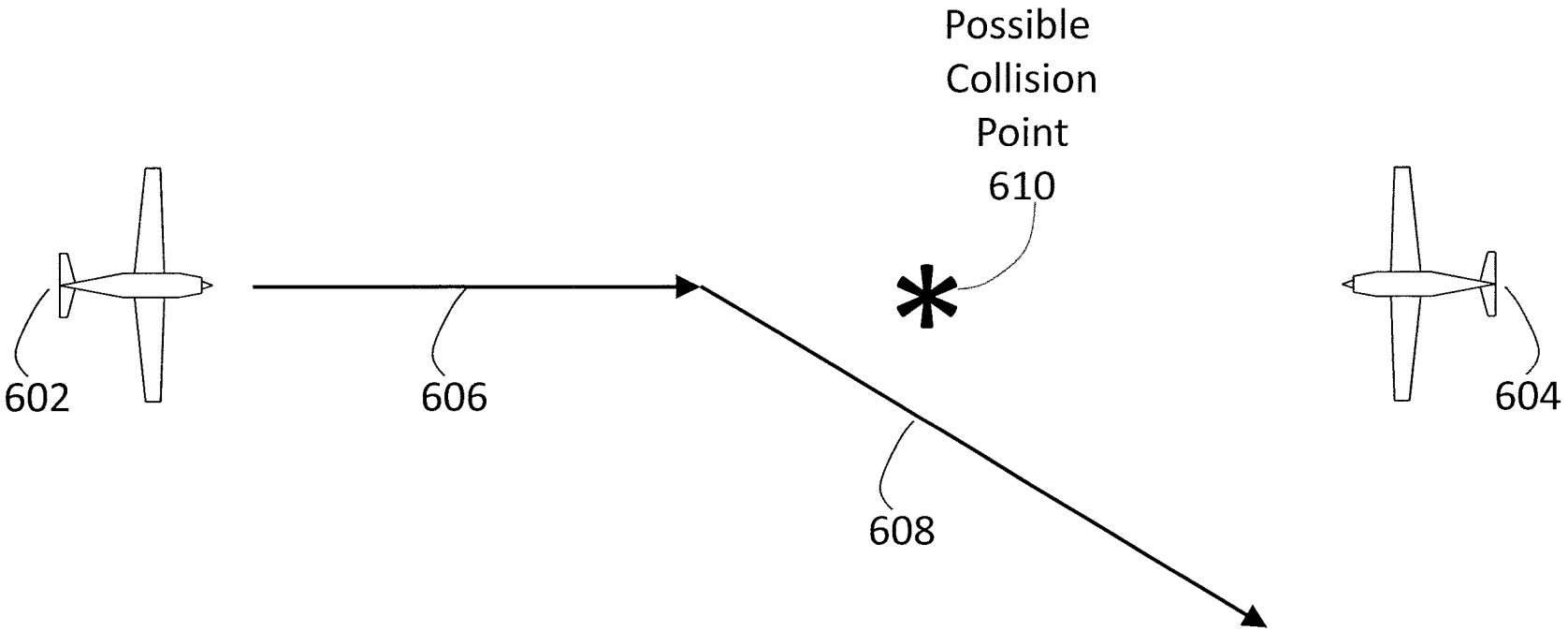
FIG. 6 illustrates an embodiment of a traffic alert system in which alerts are suppressed for other aircraft where a possible collision will be avoided by a planned course change in a flight plan.

FIG. 6 shows another embodiment of a traffic alert system 700 using an aircraft's FMS 709 or GNS 705. FIG. 6 shows a subject aircraft 602 on a collision course with a second aircraft 604. If the subject aircraft 602 and the second aircraft 604 maintain their present courses, then they would collide at the possible collision point 610. Normally, a traffic alert would be provided to prevent this collision. However, the subject aircraft 602 is following a flight plan that is programmed into the FMS or GNS. The flight plan includes a first flight leg 606 on which the subject aircraft 602 is currently flying and a second flight leg 608 onto which the subject aircraft 602 will be flying next. The subject aircraft 602 will be turning onto the second flight leg 608 before the subject aircraft 602 collides with the second aircraft 604. The embodiment of the traffic alert system 700 (its device 713) receives the flight plan information from the FMS or GNS and suppresses the alert because the subject aircraft 602, following the flight plan, will move away from the possible collision 610 with the second aircraft 604. Additionally, the traffic alert system may have an input to determine if an autoflight system, like an autopilot, is currently engaged to follow the flight plan and, if so, presume that the subject aircraft will follow the flight plan.

Figure 4:
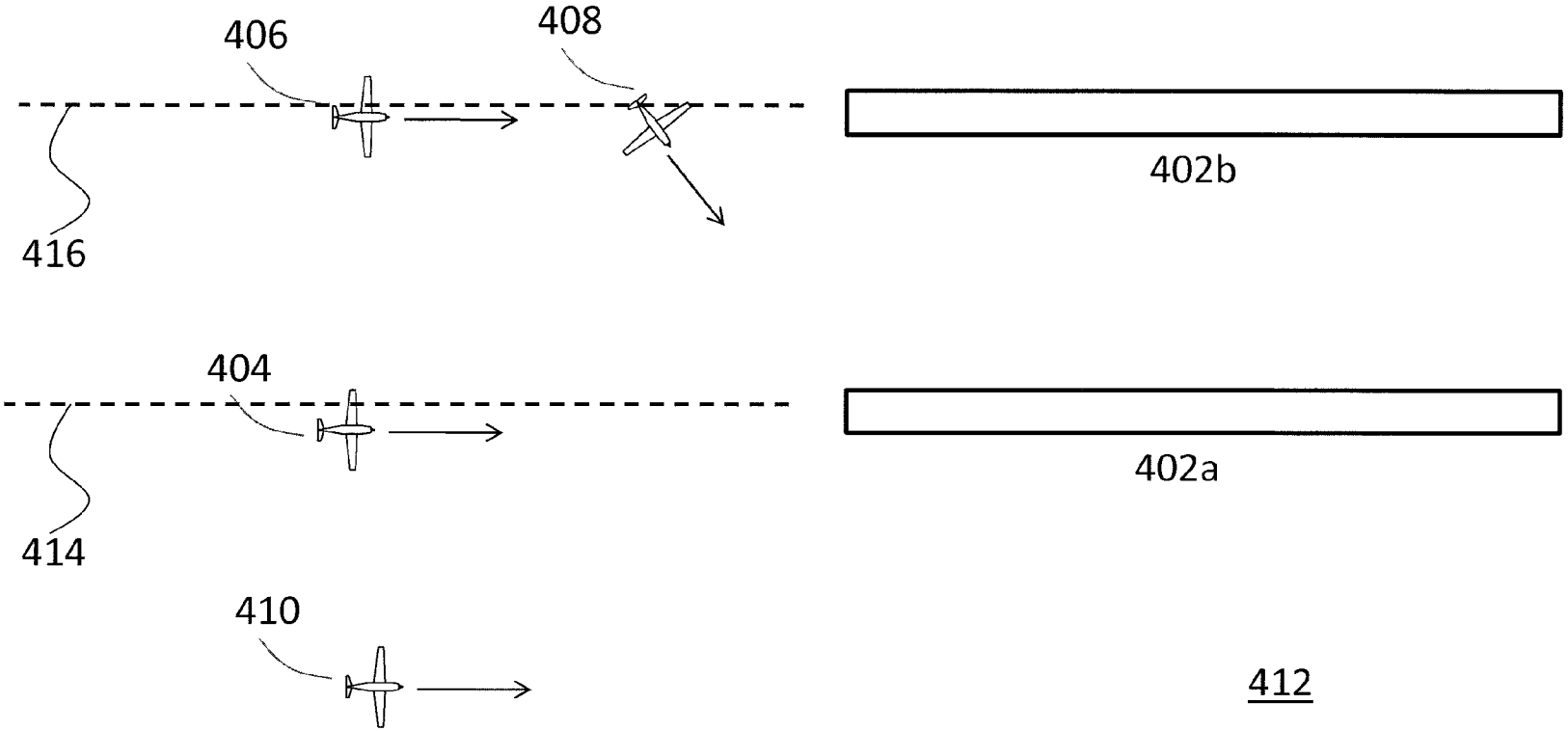
FIG. 4 illustrates an embodiment of a traffic alert system where traffic alerts are suppressed for other aircraft landing on a parallel runway.

FIG. 4 illustrates an additional embodiment that offers more sophisticated sensitivity adjustment within an airport's predetermined airport airspace boundary by including information about runways at airports and approach paths to the runways. FIG. 4 shows two parallel runways 402*a,b* at an airport 412. An aircraft 404 carrying a system 700 according to the additional embodiment is following the approach path 414 to land on runway 402*a*. A second aircraft 406 is following the approach path 416 to land on runway 402*b*. The system 700 onboard aircraft 404 detects aircraft 406, but does not issue a traffic alert because the traffic alert assembly/device 713 determines that aircraft 406 likely is landing on parallel runway 402*b* and does not pose a collision risk. A third aircraft 408 is on the approach path 416 for runway 402*b*, but the third aircraft 408 is not following the heading of approach path 416. The traffic alert assembly/device 713 onboard aircraft 404 detects the third aircraft 408 and issues a traffic alert because it cannot determine that the third aircraft 408 is landing on the parallel runway 402*b*, and therefore cannot rule out the possibility that the third aircraft 408 is on a collision course. Likewise, a fourth aircraft 410 is flying on a parallel course to the subject aircraft 404, but the fourth aircraft is not on an approach path to any runway. Again, the traffic alert assembly/device 713 onboard aircraft 404 will issue a traffic alert for the fourth aircraft 410 because it cannot determine that the fourth aircraft 410 is landing on a parallel runway and therefore cannot rule out the possibility that the fourth aircraft 410 is a collision threat.

This invention thus reduces the false alarm rate of traffic alerting systems, while also increasing the detection rates of threat aircraft due to more accurate sensitivity levels. It also reduces pilot workload of having to manually change sensitivity levels or manually setting the destination airport elevation.

Figure 5:
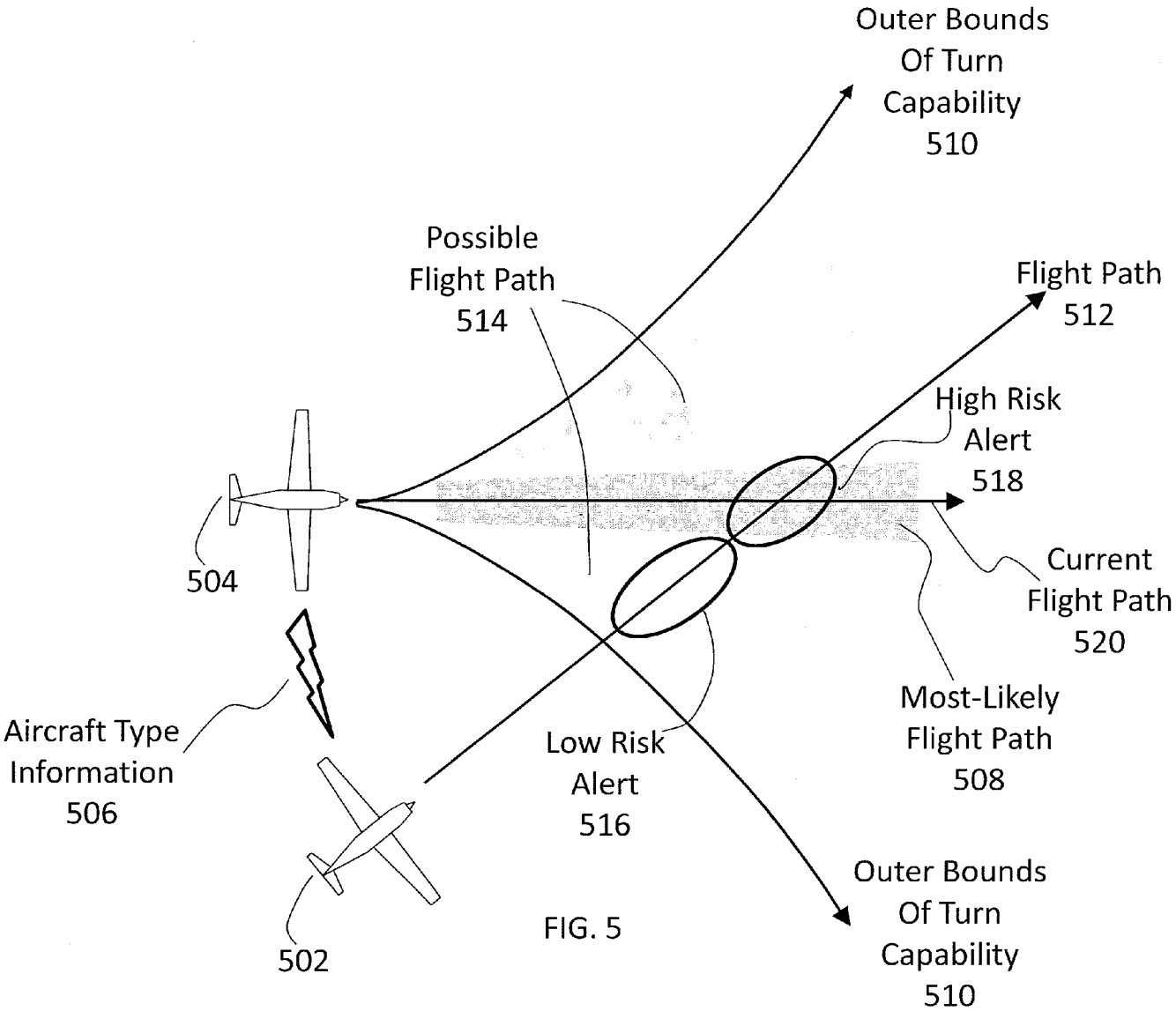
FIG. 5 illustrates an embodiment of a traffic alert system in which alerts are set based on the other aircraft's type and flight characteristics.

FIG. 5 shows another embodiment of the system 700 onboard a subject aircraft 502. The aircraft 502 is flying along a flight path 512. A second aircraft 504 is flying along a current flight path 520. The flight paths of the two aircraft intersect. The second aircraft 504 broadcasts information 506 (received by the subject aircraft 502) that can be used to identify what type of aircraft the second aircraft 504 is. For example, the second aircraft may broadcast its tail number, which can be correlated against FAA data stored in database 710 to determine the aircraft's type. If the second aircraft's type is known, then information about the second aircraft's 504 performance can be determined by the invention system/assembly 713 onboard aircraft 502. For example, the second aircraft's 504 turn capability can be determined (and also its climb performance capability) and in turn the outer bounds of the turn capability can be projected by traffic alert assembly/device 713. For instance, a Boeing 747-400 flies at high speed, but cannot turn very quickly. By contrast, a helicopter flies slowly, but can change direction quickly.

Once the second aircraft's 504 turn capability is known, the area in which the second aircraft can be located in the near future can be determined by the invention assembly/system 713 on board the subject aircraft 502. For example, the second aircraft 504 will most likely be on a flight path 508 close to its current flight path 520. However, the second aircraft 504 may have a wider possible flight path 514 if the second aircraft 504 turns closer to its limits 510. The embodiment of the traffic alert system can provide two types of alerts—a low risk alert 516 if the subject aircraft 502 will be in the possible flight path region 514, and a high risk alert 518 if the subject aircraft 502 will be in the most-likely flight path region 508 of the second aircraft 504.

The size of the high risk alert 518 region and that of the low risk alert region 516 also may be affected by other aspects of the second aircraft 504. For example, a Boeing 747-400 has a large wake vortex that small aircraft must avoid flying through. Therefore, even though the 747-400 will be traveling relatively straight, its current flight path 520 may be wider than that of a smaller aircraft to account for the separation required to avoid the wake vortex.

The invention involves a periodically updated aircraft registration database 710 being incorporated into the traffic or wake-vortex separation system. The database 710 is configured to store registration numbers (e.g. N-numbers in the US) and aircraft models for a set of aircraft. It also stores a set of characteristics for each aircraft model. If a detected aircraft's registration number (as detected by Mode-S ID or ADS-B) is in the database, the characteristics of the model are determined then used for the traffic avoidance algorithms or wake-vortex algorithms, as described above. Likewise, if a detected aircraft's aircraft model is received by the traffic system, then the characteristics of the model are determined and used for traffic avoidance or wake-vortex algorithms.

This system increases the performance of the traffic or wake-vortex avoidance system by reducing the false alarm rate and increasing the probability of correctly identifying a threat aircraft.

The teachings of all patents, published applications and references cited herein are incorporated by reference in their entirety.

While this invention has been particularly shown and described with references to example embodiments thereof, it will be understood by those skilled in the art that various changes in form and details may be made therein without departing from the scope of the invention encompassed by the appended claims.

What is claimed is:

1. An aircraft traffic alerting system, comprising:

a traffic alerting device onboard a subject aircraft having at least a high sensitivity mode and a low sensitivity mode;

a position determining device onboard the subject aircraft and configured to communicate a determined position of the subject aircraft to the traffic alerting device;

a database comprising (i) locations of airspaces, (ii) airspace classes and corresponding locations of the airspace classes, and (iii) aircraft types and characteristics of each aircraft type, the database being coupled in communication with the traffic alerting device, wherein at least one of the locations of airspaces and the locations of airspace classes includes predetermined airspace boundaries;

responsive to the position determining device communicating the determined position of the subject aircraft, the traffic alerting device (a) searching the database using the determined position, by comparing the determined position to the locations of airspaces and predetermined airspace boundaries as stored in the database, and (b) minimizing false alarms and unnecessary alerts by automatically entering the low sensitivity mode when the determined position of the subject aircraft is within a predetermined airspace boundary of an airspace found in the database by the traffic alerting device, and automatically entering the high sensitivity mode when the determined position of the subject aircraft is outside of any predetermined airspace boundary of the airspaces found in the database by the traffic alerting device, wherein the position determining device continuously determines the position of the subject aircraft and the traffic alerting device continuously compares a presently determined position to the locations of airspaces and predetermined airspace boundaries stored in the database.

2. The aircraft traffic alerting system of claim 1 wherein the position determining device is a global positioning system (GPS).

3. The aircraft traffic alerting system of claim 1 further comprising at least one of a Flight Management System (FMS) and a Global Positioning Satellite (GPS) Navigation System (GNS) onboard the subject aircraft and in communication with the traffic alerting device; and wherein the traffic alerting device receives an indication of a destination airport from the FMS or the GNS and only enters the low sensitivity mode when the determined position of the subject aircraft is within a predetermined airspace boundary of the destination airport.

4. The aircraft traffic alerting system of claim 1 further comprising at least one of a Flight Management System (FMS) and a Global Positioning Satellite (GPS) Navigation System (GNS) onboard the subject aircraft and in communication with the traffic alerting device; and wherein the traffic alerting device receives a planned flight path from the FMS or the GNS and suppresses a traffic alert related to a second aircraft if the planned flight path will move the subject aircraft away from a possible collision with the second aircraft.

5. The aircraft traffic alerting system of claim 1 wherein the traffic alerting device is configured to receive information about a second aircraft's type and to adjust traffic alerts regarding the second aircraft based on the second aircraft's characteristics.

6. The aircraft traffic alerting system of claim 1 wherein the database of locations of airports includes information about parallel runways at least one of the airports; and wherein the traffic alerting device suppresses traffic alerts related to a second aircraft if the second aircraft is on a flight path that corresponds to a final approach path for a first runway that is parallel to a final approach path for a second runway that corresponds with the subject aircraft's flight path.

7. The aircraft traffic alerting system of claim 1 further comprising:

at least one intermediate sensitivity mode between the high sensitivity mode and the low sensitivity mode, wherein each of the at least one intermediate sensitivity modes corresponds to an airspace class; and wherein the traffic alerting device adjusts sensitivity and enters one of the at least one intermediate sensitivity modes when the determined position of the subject aircraft is within the airspace class corresponding to the entered intermediate sensitivity mode.

8. The aircraft traffic alerting system of claim 7 wherein the at least one intermediate sensitivity mode comprises continuous sensitivity modes between the high sensitivity mode and the low sensitivity mode.

9. A method of alerting of aircraft traffic, comprising:

determining a position of a subject aircraft;

accessing a database containing (i) positions and predetermined boundaries of airports, (ii) location and class of airspaces, and (iii) aircraft characteristics in said database being searchable by a traffic alerting system;

searching the database using the determined position by comparing the determined position to known positions of airports and to predetermined boundaries of each airport as stored in the database, said searching and comparing being by the traffic alerting system;

minimizing false alarms and unnecessary alerts by: automatically setting the traffic alerting system in the subject aircraft to a high sensitivity level when the determined position of the subject aircraft is outside of any predetermined boundary of each airport and automatically setting the traffic alerting system in the subject aircraft to a low sensitivity level when the determined position of the subject aircraft is within the predetermined boundary of an airport; and repeating said determining, searching and minimizing, wherein said determining is repeatedly performed such that respective presently determined positions of the subject aircraft are determined, and said searching by comparing is repeated using the respective presently determined position of the subject aircraft, and continuous minimizing of false alarms and unnecessary alerts results.

10. The method of claim 9 wherein determining the position of a subject aircraft includes determining the position in a global positioning satellite (GPS) receiver.

11. The method of claim 9 further comprising determining the subject aircraft's planned flight path and suppressing any traffic alerts related to a second aircraft if the planned flight path will move the subject aircraft away from a possible collision with the second aircraft.

12. The method of claim 9 further comprising determining a second aircraft's type and flight characteristics associated with the second aircraft's type; and adjusting traffic alerts regarding the second aircraft based on the second aircraft's flight characteristics.

13. The method of claim 9 further comprising suppressing traffic alerts related to a second aircraft if the second aircraft is on a flight path that corresponds to a final approach path for a first runway that is parallel to a final approach path for a second runway that corresponds with the subject aircraft's flight path.

14. The method of claim 9 further comprising determining the class of airspace in which the subject aircraft is positioned; and adjusting the sensitivity level of the traffic alerting system to an intermediate level between the high sensitivity level and the low sensitivity level that corresponds to the determined class of airspace.

15. The method of claim 9 further comprising determining the subject aircraft's destination airport and only automatically setting the traffic alerting system to the low sensitivity level when the determined position of the subject aircraft is within the predetermined boundary of the destination airport.

* * * * *